US005781287A

United States Patent [19]

Heinzl et al.

[11] Patent Number: 5,781,287

[45] Date of Patent: Jul. 14, 1998

[54] COIL BODY FOR MINIATURE RELAYS AND THE LIKE

[75] Inventors: Alfred Heinzl; Heinz Stadler, both of Munich, Germany

[73] Assignee: Siemens Aktiengesellschaft, Munich, Germany

[21] Appl. No.: 642,881

[22] Filed: May 6, 1996

[30] Foreign Application Priority Data

May 18, 1995 [DE] Germany ..... 19518349.5

[51] Int. Cl.[6] ..... H01F 27/29; H01F 27/30

[52] U.S. Cl. ..... 336/192; 242/437.3; 336/198

[58] Field of Search ..... 242/437, 437.3, 242/437.4, 604; 336/198, 208, 192

[56] References Cited

U.S. PATENT DOCUMENTS

| | | | |
|---|---|---|---|
| 2,428,826 | 10/1947 | Bauer | 336/208 |
| 3,648,208 | 3/1972 | Rolf | 336/208 |
| 4,891,620 | 1/1990 | Cheng | 336/198 |

FOREIGN PATENT DOCUMENTS

| | | | |
|---|---|---|---|
| 69 03 063 | 1/1969 | Germany . | |
| 38 35 105 C2 | 9/1990 | Germany . | |
| 59-103316 | 6/1984 | Japan | 336/198 |
| 62-140402 | 6/1987 | Japan | 336/208 |
| 149937 | 5/1955 | Sweden | 336/198 |

*Primary Examiner*—Thomas J. Kozma
*Attorney, Agent, or Firm*—Hilt & Simpson

[57] ABSTRACT

A coil body consists of a coil tube having flanges integrally formed onto the ends and having an axially through-extending opening. This core opening is formed by a successive arrangement of radial recesses which alternately extend through the coil tube wall from opposite sides. These radial recesses are formed by of reciprocally opposed projections of two cooperating mold halves of an injection molding tool. Such an arrangement permits manufacture of winding coil bodies with a simple two-part mold, eliminating a need for moveable components for forming the axial spindle core opening during the molding operation. The resulting coil body includes the continuous axial spindle opening defined by wall segments around its entire periphery and for easy attachment to a winding spindle for winding.

12 Claims, 4 Drawing Sheets

COIL BODY FOR MINIATURE RELAYS AND THE LIKE

BACKGROUND OF THE INVENTION

The invention generally concerns a coil body, in particular for miniature relays. More specifically, the invention concerns such a coil made of insulating material, having a coil tube winding bearer with an axially continuous core opening and a one-piece flange respectively formed integrally at each end of the coil tube. Moreover, the invention concerns a method for the manufacture of a coil body of this type.

Coil bodies for relays are typically formed with injection molding tools, whereby the outer contours are formed via two mold halves. During this molding process, an axially continuous opening is conventionally generated via so-called core pullers, i.e., specially driven bars in the mold. Such additional bars, movable in relation to the mold halves, require a complicated mold design, expensive control and increased time outlay.

DE 38 35 105 C2 discloses a relay having a coil body with a U-shaped cross-section, so that the coil body forms an open continuous longitudinal slot. This coil body can be injection molded without the use of core pullers. However, due to the continuous open slot, it cannot be placed on a standard winding spindle. The core is thereby not placed axially, but rather is laterally inserted onto a spindle. Then, the winding is attached.

DE 69 03 063 U discloses a coil body made of a hollow core piece and two end flanges perpendicular to the coil axis. The coil body can be manufactured with a two-part mold. The mold halves are moved in the axial direction of the coil body, whereby the flanges are respectively alternately interrupted in segmented form in order to enable the passage of the respective mold segment. However, in that coil body, it is not possible to provide radial plug channels for coil connection elements in the area of the flange.

An object of the present invention is to provide a coil body which can be manufactured in a simple two-part injection mold without relatively moving parts. An additional object is to provide such a coil body which is suitable for subsequent processing in the same way as conventionally manufactured coil bodies, e.g., through placement on a winding spindle and through winding of the winding ends onto connection pins in the coil flange.

SUMMARY OF THE INVENTION

The objects are inventively achieved in a coil body of the type named above in that the core opening is formed by a plurality of radial recesses in the coil tube that are alternately opposed to one another, which connect to one another without intermediate space, and which overlap one another in the region of the mid-axis of the coil tube.

The manufacture of this coil body inventively takes place with a two-part mold whose mold parting plane runs through the coil axis or parallel to it, whereby the outer contour of the coil body is predetermined by the two mold halves. A continuous filled core region is formed by alternating mold projections arranged opposite one another in an axial region of the mold cavity that projects in the radial direction. The core region yields the desired continuous core opening after the filling of the remaining cavities with plastic and after separation of the mold halves.

Accordingly, the inventively formed coil body has a coil tube integrally held together over the entire perimeter by insulating material, even though its walls are alternately interrupted on facing sides. The coil body can be fit onto a standard winding spindle for winding, and after the winding, it can receive a standard axially inserted core.

The above-mentioned interruptions in the wall of the coil tube cause no disturbance during the winding, and also do not significantly reduce the stability of the coil body. The insulating distance between the winding and the core is also ensured, in particular given a rectangular or nearly rectangular cross-section of the coil tube. The length of the respective interruptions depends on the number of alternating projections provided in the two injection molds; these may be selected to correspond to the desired structure of the coil body, the desired size of individual cavities and depending on the flow behavior of the insulating material.

The winding wire can be led from a connection pin directly to the lowest winding layer through the window of the coil tube, which is also inventively provided in the flange areas, without being crushed by the windings that lie above. A strain relief is also possible in a simple fashion through a subsequent pushing of the connection pin.

An advantage of the inventive structure of the coil body and the corresponding manufacturing method is that it is simpler and less costly than the manufacturing of conventional coil bodies. The mold clusters for the simultaneous molding of a larger number of coil bodies can be arranged very closely next to one another due to the absence of additional driven moving parts. Therefore, the gates are also shortened, and a larger number of coil bodies can be manufactured in one mold injection cycle.

Additional features and advantages of the present invention are described in, and will be apparent from, the detailed description of the preferred embodiments and from the drawings.

DETAILED DESCRIPTION OF THE PREFERRED EMBODIMENTS

Figure 1:
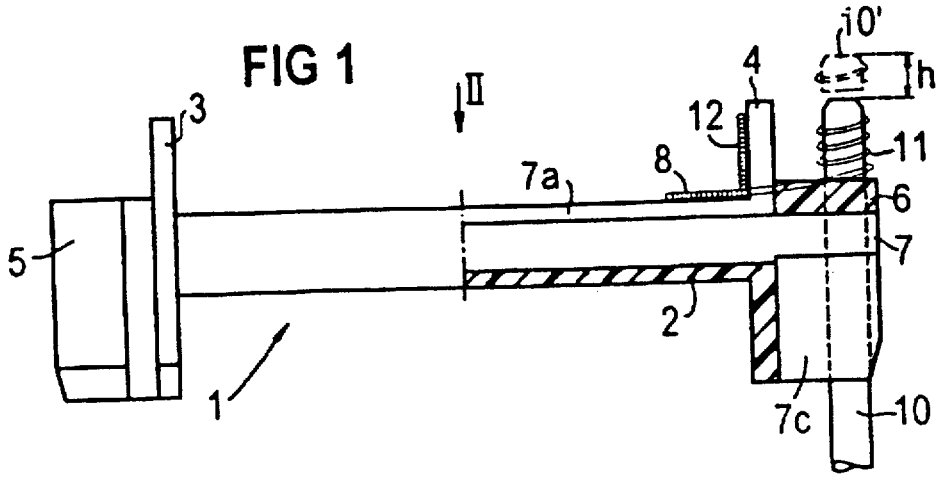
FIG. 1 is a partially sectional plan view of a coil body according to the present invention, the section viewed generally along I—I of FIG. 2.
Figure 2:
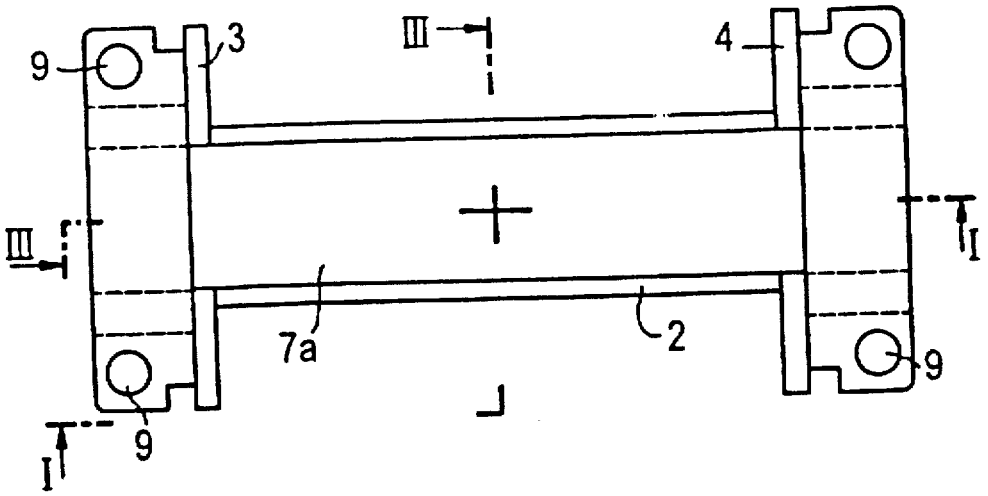
FIG. 2 is a side elevation of the coil body of FIG. 1 as viewed from II indicated in FIG. 1.
Figure 3:
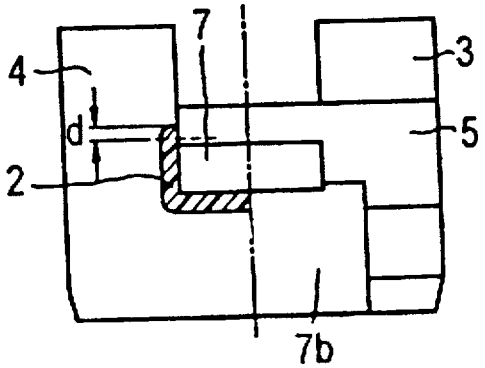
FIG. 3 is a partially sectional end elevation taken generally along line III—III of FIG. 2.

A coil body 1 according to the present invention is shown in FIGS. 1—3. The coil body 1 is injection-molded entirely from plastic. It consists of a coil tube 2 having a middle winding section, flanges 3 and 4 formed integrally at the end areas of the winding section and end tube sections or frontal flange projections 5 and 6, which extend radially outwardly from the flanges 3 and 4.

The coil body has an axial core opening 7 which extends its entire length, formed by means of opposed radial recesses intervening alternately into the coil tube. In the example of FIGS. 1 to 3, three radial recesses of this sort are provided, namely one extending from the top side over the entire winding length from the flange 3 up to the flange 4, as well as two radial recesses 7b and 7c extending from underneath and into the flange projections 5 and 6. The coil tube thus has connected wall elements over its entire periphery.

These wall elements are interrupted from one side and the other by the window-shaped recesses 7a, 7b and 7c, but they nonetheless provide the necessary stability for the coil tube and enable the coil body to be attached to a winding spindle. The rectangular section of the coil tube 2 ensures that even the lower winding layer remains taut over the recess 7a at the same height as it would be if the coil tube 2 were also to include a closed wall on its top side.

In the flange projections 5 and 6, open plugging channels 9 are formed to receive winding connection pins 10. In the example shown, the winding connection pins 10 are subsequently inserted, as indicated in FIG. 1 (in FIGS. 2 and 3 this pin is not shown). Due to the fact that the radial recess 7a extends into the area of the flange 4, the winding wire 11 can be led from the winding connection pin 10 directly through the recess in the flange 4 to the lowest winding layer 8. The coil wire can thus remain uncrushed by the windings 12 lying above. Likewise, no punctures can ensue.

A strain relief is also possible. For this purpose, the connection pin 10 is first brought into the position designated 10' and shown with broken lines, and is wound with the beginning of the wire. After the winding, the connection pin is pushed down through the distance "h", by which means the tension of the beginning of the wire slackens.

Figure 4:
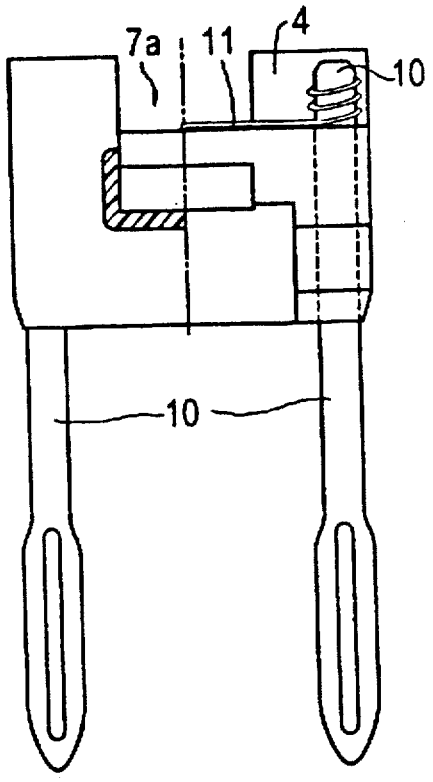
FIG. 4 is a partially sectional end elevation of the of a coil body according to FIGS. 1–3 having additionally inserted connection pins.

FIG. 4 shows the same view of the frontal side of the coil body as FIG. 3, but with two inserted connection pins 10. Here, the leading of the beginning of the winding 11 from the connection pin 10 through the recess 7a in the flange 4 is also again shown.

Figure 5:
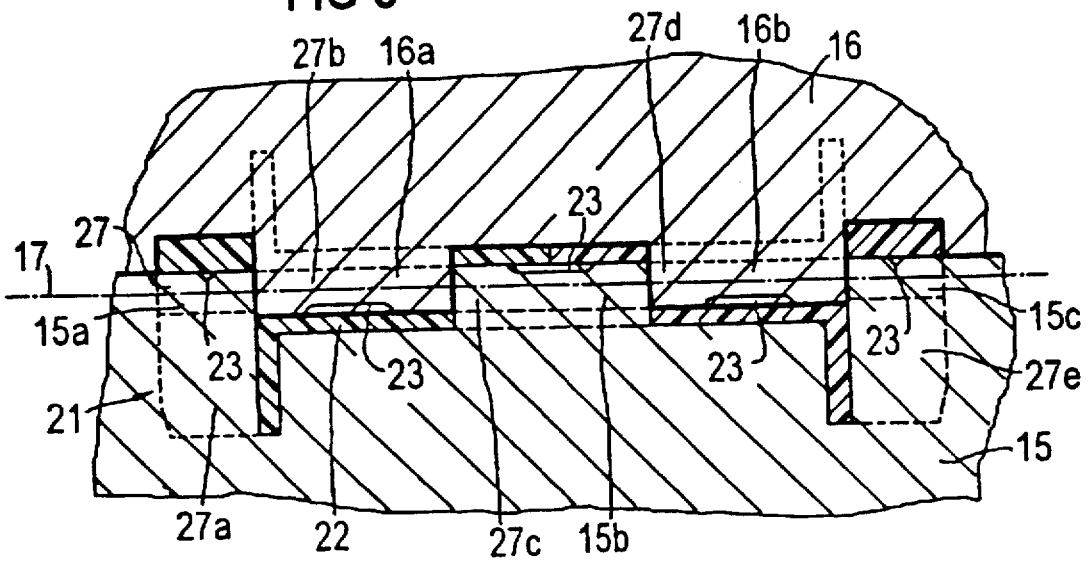
FIG. 5 is a sectional side elevation of another coil body embodiment in a mold according to the present invention.

The manufacture of the coil body is again briefly explained on the basis of FIG. 5. The coil body 21 shown here is represented in longitudinal section, similar to FIG. 1. In comparison to the coil body in FIG. 1, the coil tube 22 in this case is permeated with five radial recesses 27a to 27e, for the formation of the core opening 27. In FIG. 5, the coil body is still shown inside the injection mold, whereby this mold consists of a lower mold half 15 and an upper mold half 16. The mold parting plane 17 runs parallel to the axis and close to the axis of the coil body 21. The radial recesses 27a, 27c and 27e on the lower side of the coil body are produced by projections of the lower mold half 15, namely the projections 15a, 15b and 15c, while the radial recesses 27b and 27d, which open inwardly from the top, are formed by projections 16a and 16b on the upper mold half 16. The coil tube 22 is formed from plastic by means of injection molding in the remaining cavities. The mold is subsequently opened, and the coil body produced can be further processed.

As additionally shown in FIG. 5, displacement ribs 23 are shown that serve for the clamped holding of the core in the coil body. They can be provided in any form desired by the radial projections 15a to 16b of the injection mold in a particularly simple fashion.

Figure 6:
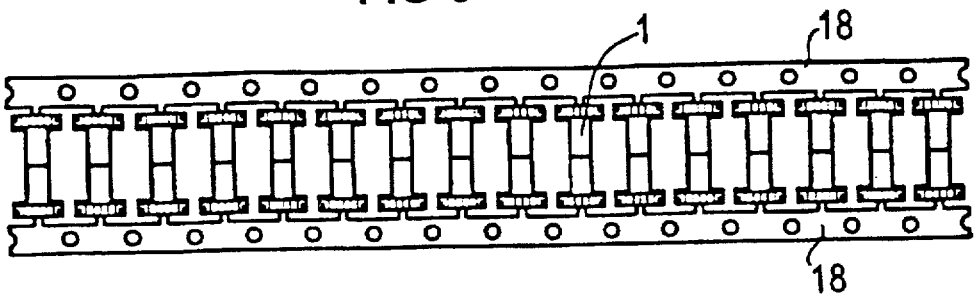
FIG. 6 is a plan view of a row of coil bodies manufactured in an injection molding cycle, the coil bodies having two common molding bars connected on opposite sides.
Figure 7:
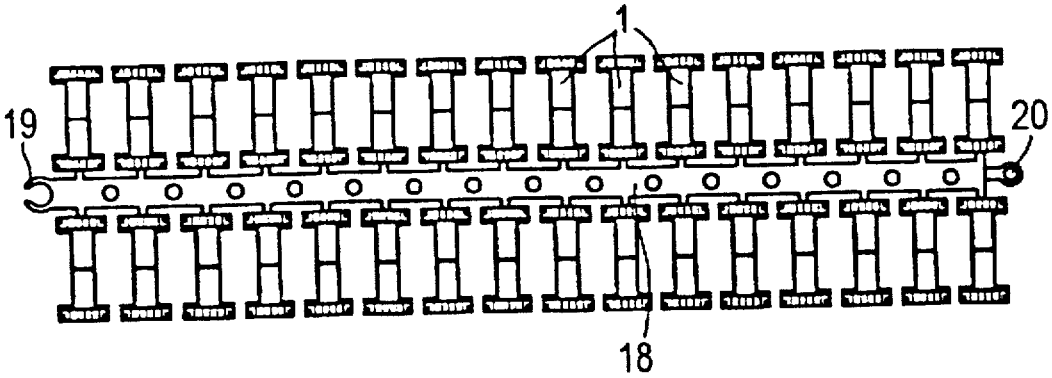
FIG. 7 is a plan view of two rows of coil bodies manufactured in an injection molding cycle, the two rows of coil bodies sharing a common middle molding bar.

FIGS. 6 and 7 show a particularly advantageous arrangement for the common molding of several coil bodies. By means of simple molding without relatively movable crossbars, the individual mold recesses can be arranged closely next to one another. FIG. 6 thus shows a row of coil bodies 1, arranged next to one another in parallel fashion and commonly molded, which are at first connected via two molding bars 18 and are thus easily handled for further processing. FIG. 7 shows an arrangement of coil bodies 1 in a double row, having a common middle molding bar 18. Here, the molding bar has an eyelet 19 molded on at one end, and on the other end, has a molded knob 20. In the injection molding tool, for this purpose there is a receptacle in which the last-molded strip piece lies, its knob 20 protruding into the mold cavity. The subsequently molded strip piece thereby connects with the preceding one, i.e., the eyelet 19 of the following strip connects with the knob 20 of the preceding strip, so that through the successive injection molding cycles an endless strip arises, which can be very conveniently processed in a production line.

If a particularly narrow coil construction is desired, additional space may be saved by not permitting the edges of the coil tube on the open side of the recess 7a (in FIG. 3), extending substantially along the winding length, from projecting beyond the entire thickness of the wall of the coil tube, but rather by reducing the projection to a height measure "d" indicated in FIG. 3. In other words, the winding section has a smaller radial dimension than the end tube section. The winding then lies at the open side of the coil tube only at a very small distance over the core, e.g., about 0.05 mm, with the wall thickness of the coil tube otherwise 0.4 mm. The coil can then receive a particularly small extension in this direction.

Figure 8:
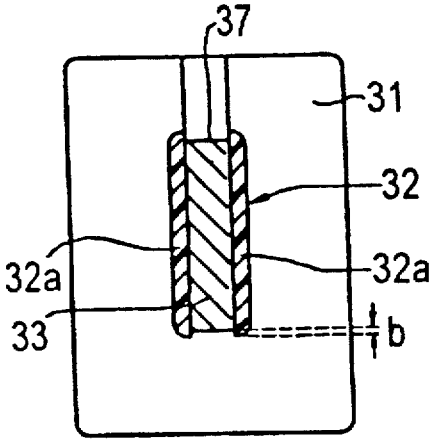
FIG. 8 is a sectional view of a further coil body embodiment according to the present invention.

In FIG. 8, a coil body 31 is shown in a cross-section through its coil tube 32, in which the coil tube 32 is open in the area of the winding on two facing longitudinal sides. The remaining longitudinal sides 32a exceed the height of the core opening 37 or, respectively, the core 33, above and below only by a very small height measure "b". The winding thus receives, on two facing sides, only the minimum distance to the core 33 necessary for insulation, by which means additional volume is saved. In the area of the flange, this coil body 31 is also constructed in the manner of the coil body 1 in FIGS. 1 to 3.

Figure 9:
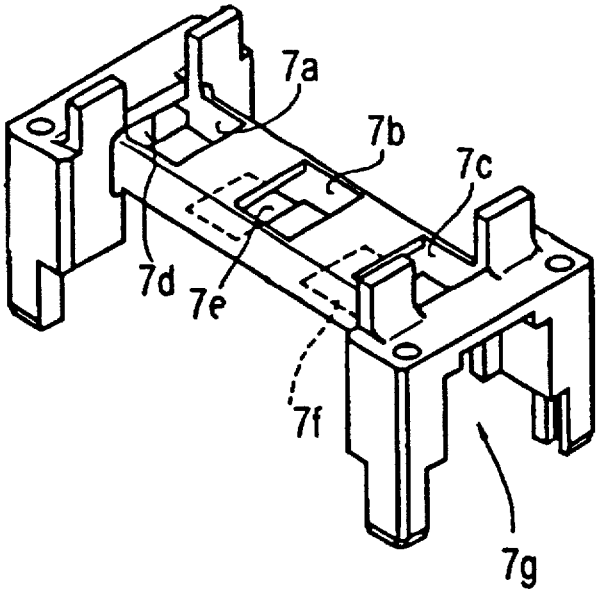
FIG. 9 is a perspective view of an additional coil body embodiment according to the present invention.

FIG. 9 illustrates an embodiment wherein the coil tube has three recesses 7a, 7b and 7c on a top side of the coil tube and four recesses 7d, 7e, 7f and 7g at a bottom side of the coil tube. The top recesses 7a, 7b and 7c are alternating and oppositely arranged relative to the bottom recesses 7d, 7e, 7f and 7g.

It should be understood that various changes and modifications will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A one-piece insulative coil body comprising:

a coil tube having opposed end segments, at least two opposite sides extending between the end segments, and a central axis, the coil tube being adapted for bearing windings;

a pair of one-piece flanges, one of the flanges respectively formed integrally on each end segment of the coil tube;

at least one radial recess extending between the end segments, each formed radially into one of the opposite sides to a depth beyond the central axis;

a first recess formed axially adjacent one of the at least one radial recesses and radially into one of the opposite sides and one of the end segments to a depth beyond the central axis;

a second recess formed axially adjacent one of the at least one radial recesses and radially into one of the opposite sides and another of the end segments to a depth beyond the central axis;

each recess being formed into an alternatingly opposite side of the coil tube relative to each adjacent recess; and an axially continuous core opening extending completely through the coil tube and shaped to receive a winding spindle, the core opening formed by the depth of each of the adjacent recesses.

2. The coil body according to claim 1, further comprising:

a plurality of plugging channels provided in the flanges oriented parallel to the radial recesses, each plugging channel having a winding connection pin received therein.

3. The coil body according to claim 2, wherein the connection pins have winding regions which adjoin respective of the radial recesses that permeate the respective flanges.

4. The coil body according to claim 1, wherein the coil tube further comprises:

an end tube section at each end extending axially outwardly from the respective flange; and the at least one radial recess is a radial recess defining an open side extending continuously over a winding length defined between the flanges, whereby an edge of the coil tube on the open side is disposed closer to the central axis than an outer edge of a wall forming the end tube section.

5. The coil body according to claim 4, wherein the continuous radial recess extends completely through the winding section, and wherein each of two facing longitudinal sides defining the winding section have outer edges closer to the central axis than the outer edge of the wall forming the end tube section.

6. A one-piece coil body comprising:

a coil tube having at least two opposed sides, a middle winding section, a pair of integral flanges at opposite ends of the winding section, and end tube sections extending axially outwardly from the respective flanges;

at least one radial recess extending between the flanges, each formed radially into one of the opposed sides of the coil tube and the flanges to a depth beyond the central axis:

a first recess formed axially adjacent one of the at least one radial recesses and radially into the coil tube and one of the end tube sections into one of the opposed sides to a depth beyond the central axis;

a second recess formed axially adjacent one of the at least one radial recesses and radially into the coil tube and another of the end tube sections into one of the opposed sides to a depth beyond the central axis:

each recess being formed into an alternatingly opposite one of the opposed sides relative to each adjacent recess; and an axially continuous core opening extending completely through the coil tube and shaped to receive a winding spindle, the core opening formed by the depth of each of the adjacent recesses.

7. The coil body according to claim 6, further comprising:

a plurality of plugging channels provided in the flanges oriented parallel to the radial recesses, each plugging channel being adapted to receiving a winding connection pin.

8. The coil body according to claim 6, wherein the at least one radial recess is a radial recess extending continuously over a length of the winding section defined between the flanges, a radial dimension of the winding section being smaller than a radial dimension of the end tube sections.

9. The one-piece insulative coil body according to claim 1 further comprising:

a plurality of radial recesses extending between the end segments wherein each of the plurality of radial recesses is formed into an alternatingly opposite side of the coil tube relative to each adjacent recess.

10. The one-piece coil body according to claim 6, further comprising:

a plurality of radial recesses extending between the flanges wherein each of the plurality of radial recesses is formed into an alternatingly opposite one of the opposed sides relative to each adjacent recess.

11. The one-piece insulative coil body according to claim 1, wherein the at least one radial recess is also formed radially into each of the flanges.

12. The one-piece insulative coil body according to claim 1, wherein the first recess is also formed radially into one the flanges and the second recess is also formed radially into another of the flanges.

* * * * *